US005493264A

United States Patent [19]

Menier et al.

[11] Patent Number: 5,493,264

[45] Date of Patent: Feb. 20, 1996

[54] PROTECTION APPARATUS FORMED BY ASSOCIATION OF A CIRCUIT BREAKER IN SERIES WITH AN EFFECTOR

[75] Inventors: Alain Menier, Chirens; Eric Domejean, Grenoble; Alain Frolla, Brignoud; Jean-Jacques Nardin, Moirans, all of France

[73] Assignee: Schneider Electric SA, France

[21] Appl. No.: 317,543

[22] Filed: Oct. 4, 1994

[30] Foreign Application Priority Data

Oct. 15, 1993 [FR] France ..... 93 12407

[51] Int. Cl.[6] ..... H01H 75/00

[52] U.S. Cl. ..... 335/14; 335/20; 218/16

[58] Field of Search ..... 335/14, 20, 201; 218/15–21

[56] References Cited

U.S. PATENT DOCUMENTS

| | | | |
|---|---|---|---|
| 2,551,302 | 5/1951 | Theunissen | 335/201 |
| 4,456,832 | 6/1984 | Greer et al. | 335/20 |
| 4,532,486 | 6/1985 | Terrier | 335/14 |
| 5,079,529 | 1/1992 | Ohishi et al. | 335/14 |

FOREIGN PATENT DOCUMENTS

| | | |
|---|---|---|
| 0104981 | 4/1984 | European Pat. Off. . |
| 0211707 | 2/1987 | European Pat. Off. . |
| 0350825 | 1/1990 | European Pat. Off. . |

OTHER PUBLICATIONS

Patent Abstracts of Japan, vol. 14, No. 89 (E–0891) Feb. 1990.

*Primary Examiner*—Lincoln Donovan
*Attorney, Agent, or Firm*—Parkhurst, Wendel & Rossi

[57] ABSTRACT

An electrical protection apparatus is formed by association of a circuit breaker electrically connected in series with an effector. Switching of the arc onto an electrode when tripping of the mechanism occurs following a fault causes shunting of the effector. The electrode is separated from the stationary contact by an insulating gap, which is dimensioned to enhance said switching of the arc onto the electrode at the beginning of the opening travel of the movable contact, and to guarantee the dielectric withstand in the closed state of the contacts of the circuit breaker, and in the open state of the effector.

1 Claim, 6 Drawing Sheets

PROTECTION APPARATUS FORMED BY ASSOCIATION OF A CIRCUIT BREAKER IN SERIES WITH AN EFFECTOR

BACKGROUND OF THE INVENTION

The invention relates to an electrical protection apparatus, formed by association of a circuit breaker and an effector, the circuit breaker comprising a first switch circuit with stationary and movable contacts, a mechanism controlled by an electromagnetic trip device with operating coil and by a thermal trip device, a pair of first and second arc guiding horns associated with a switching electrode, arranged near the contacts of the first switch circuit, an arc extinguishing chamber in the trip devices circuit, an input terminal, and an output terminal, the effector having a second switch circuit arranged to be electrically connected in series with said first switch circuit, when the latter is in the closed state, and to be automatically shunted by switching of the arc onto the electrode when the mechanism trips following a fault.

In a known apparatus of the kind mentioned, described in the document EP-A-104,981, the effector is formed by a static switch connected in series with the circuit breaker contacts. In a first embodiment, the switch is connected between the stationary contact and the input terminal, whereas the movable contact is connected to the output terminal by means of the thermal trip device and electromagnetic trip device. The switch is automatically shunted when the arc switches onto the lower guiding horn, which is permanently at the potential of the input terminal. To obtain high-speed arc switching, the connecting conductor extending the arcing horn to constitute the shunting circuit has to be placed as close as possible. The effect of proximity of this conductor enhances switching of the arc resulting in high-speed protection of the effector, but gives rise to problems of dielectric withstand when the circuit breaker contacts are closed and the switch is in the open state. In a second embodiment, the switch is connected between the trip devices and the output terminal, and the two are guiding horns are connected respectively to the input terminal and the output terminal. In the event of a fault occurring, shunting of the switch is established with a delay, for it is necessary to wait until the end of the opening travel of the movable contact of the circuit breaker to obtain switching of the arc onto the guiding horn which is at the potential of the output terminal.

SUMMARY OF THE INVENTION

The object of the invention is to improve the protection and dielectric withstand of an apparatus with circuit breaker and effector.

The apparatus according to the invention is characterized in that the switching electrode is separated from the stationary contact by an insulating gap, and is connected to one of the ends of the control coil of the electromagnetic trip device, the second switch circuit of the effector is connected to the stationary contact of the first switch circuit, and to said end of the coil, the insulating gap is shaped to enhance high-speed migration of the arc root onto the electrode when opening of the circuit breaker on a fault occurs and to guarantee the dielectric withstand in the closed state of the circuit breaker, and in the open state of the effector.

Such an arrangement enables the problem of high-speed protection of the effector against the effects of a short-circuit current to be conciliated with that of the dielectric withstand of the apparatus.

According to one feature of the invention, the insulating gap is composed of a first air space situated between the lower part of the stationary contact and the electrode in the shape of a half-loop, and of an intermediate wall made of rigid insulating material acting as support for the stationary contact, said wall extending opposite the movable contact between the stationary contact and a conducting branch extending the electrode towards the end of the coil.

BRIEF DESCRIPTION OF THE DRAWINGS

Other advantages and features will become more clearly apparent from the following description of an illustrative embodiment of the invention, given as a non-restrictive example only and represented in the accompanying drawings, in which:

In FIGS. 1 and 2, an electrical protection apparatus 10 is formed by association of a circuit breaker 12 with a remote-controlled effector 14. The circuit breaker 12 comprises a first switch circuit 16 electrically connected in series with a second switch circuit 18 of the effector 14.

Figure 1:
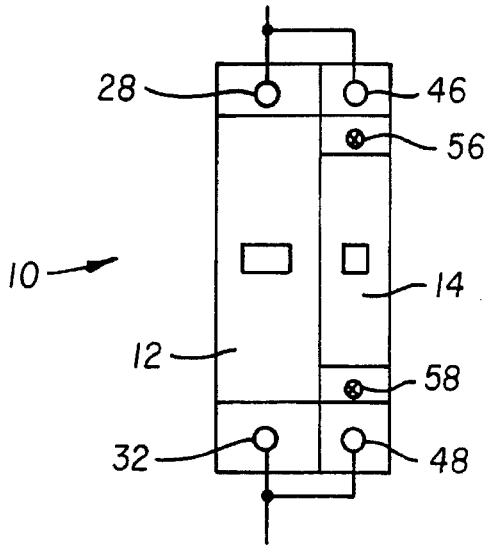
FIG. 1 is a schematic view of a single-pole electrical apparatus according to the invention.

The first switch circuit 16 of the circuit breaker comprises a stationary contact 20 cooperating with a movable contact 22, which is connected by a braid 24 to a bimetal strip of a thermal trip device 26. The foot of the bimetal strip is connected to an input terminal 28 and to a first arc guiding horn 30. The output terminal 32 is connected to one of the ends **34*b* of a coil 34 of an electromagnetic trip device 36, the other end 34*a* being at the potential of a switching electrode 38, and of a second arc guiding horn 40, The stationary contact 20 is electrically insulated from the coil 34 and electrode 38 by an insulating gap 42. The electromagnetic trip device 36 is equipped with a tripping part 44 arranged to bring about tripping of the mechanism 43 when a short-circuit current occurs, and to play the role of a striker propelling the movable contact 22 to the open position. The two horns 30, 40 frame an arc extinguishing chamber 45** which is formed by stacking of deionisation plates.

The second switch circuit 18 of the effector 14 is connected to a pair of connection terminals 46, 48 so as to be electrically connected to the stationary contact 20 by a first connecting strip 50, and to the end **34*b* of the coil 34 by a second connecting strip 52. Actuation of the contacts of the second switch circuit 18 is performed by a control device 54 for example of the electromagnet type connected to auxiliary control terminals 56, 58. The two strips 50, 52 are connected respectively to the connection terminals 46, 48 of the effector 14 by a pair of conductors 60, 62**.

The effector 14 can be formed either by a remote-controlled switch, or by an electromagnetic or static contactor, or by any other electrical endurance device, with serial connection of its second switch circuit 18 in the main circuit of the circuit breaker 12.

In the closed state of the circuit breaker 12 and effector 14, the current enters the apparatus 10 via the input terminal 28, flows successively in the bimetal strip of the thermal trip device 26, contacts 22, 20 of the first switch circuit 16, first connecting strip 50, conductor 60, contacts of the second switch circuit 18, conductor 62, second connecting strip 52, and then flows through the coil 34 of the electromagnetic trip device 36 and is output from the apparatus 10 via the output terminal 32.

Operation of a receiver (not represented) connected to the output terminal 32 is achieved normally by actuation of the control device 54 of the effector 14 following sending of a control signal to the auxiliary terminals 56, 58. In the case of a remote-controlled switch, each control impulse applied to the terminals 56, 58 causes a change of state of the second switch circuit 18. If the effector 14 is formed by a contactor, the second switch circuit 18 is continuously in the closed state in the presence of a maintained control signal. Opening of the contactor is automatic as soon as the control signal disappears.

In the open state of the first switch circuit 16 following a manual or automatic action of the mechanism 43 of the circuit breaker 12, everything which is load-side of the stationary contact 20 is powered off, notably the coil 34 of the electromagnetic trip device 36 and the whole circuit of the effector 14. The presence of the insulating gap 42 then enables installation and disassembly operations of the effector 14 to be carried out in complete safety as soon as the circuit breaker 12 is open.

The occurrence of a short-circuit or overload current load-side of the output terminal 32 causes automatic tripping of the mechanism 43 by the action of the electromagnetic trip device 36 or of the thermal trip device 26 electrically connected in series with an effector 14. Switching of the arc onto an electrode 38 when tripping of the mechanism occurs following a fault causes shunting of the effector 14. The electrode 38 is separated from the stationary contact 20 by an insulating gap 42, which is dimensioned to enhance said switching of the arc onto the electrode 38 at the beginning of the opening travel of the movable contact 22, and to guarantee the dielectric withstand in the closed state of the contacts 20, 22, the tripping part 44 of the electromagnetic trip device 36 then keeps the movable contact 22 in the open state until the arc is extinguished.

Figure 2:
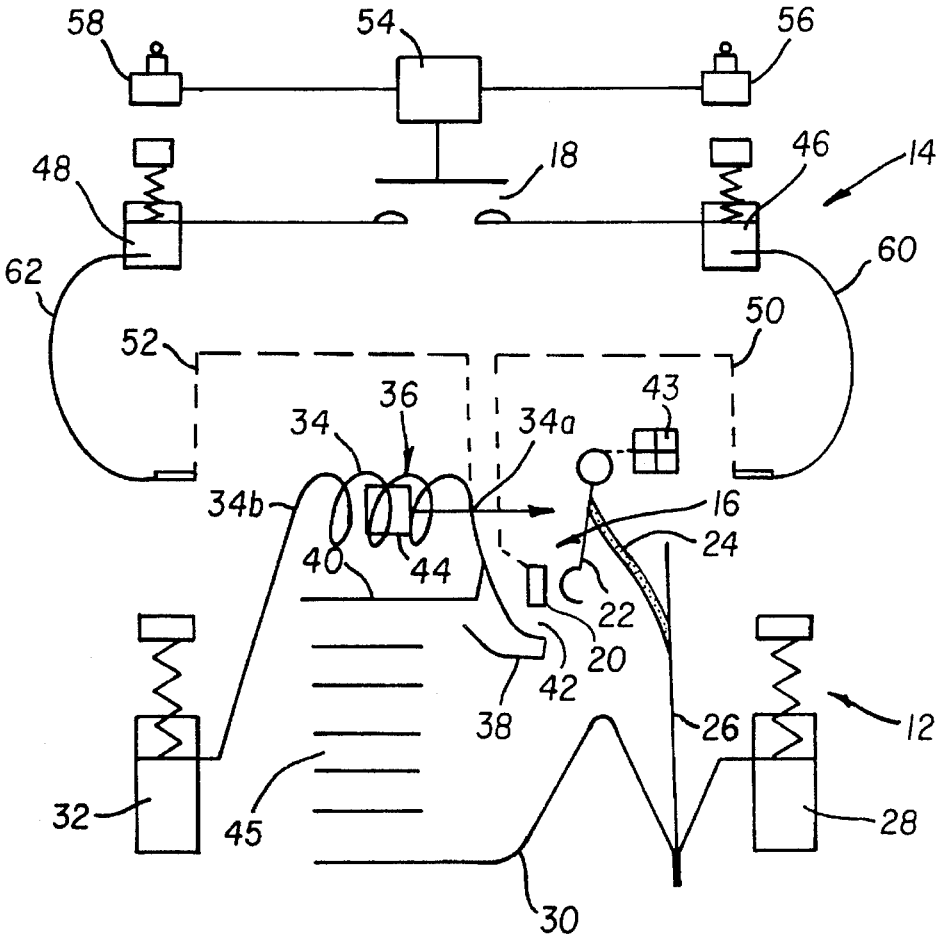
FIG. 2 shows the electrical circuit of the apparatus according to FIG. 1.
Figure 3:
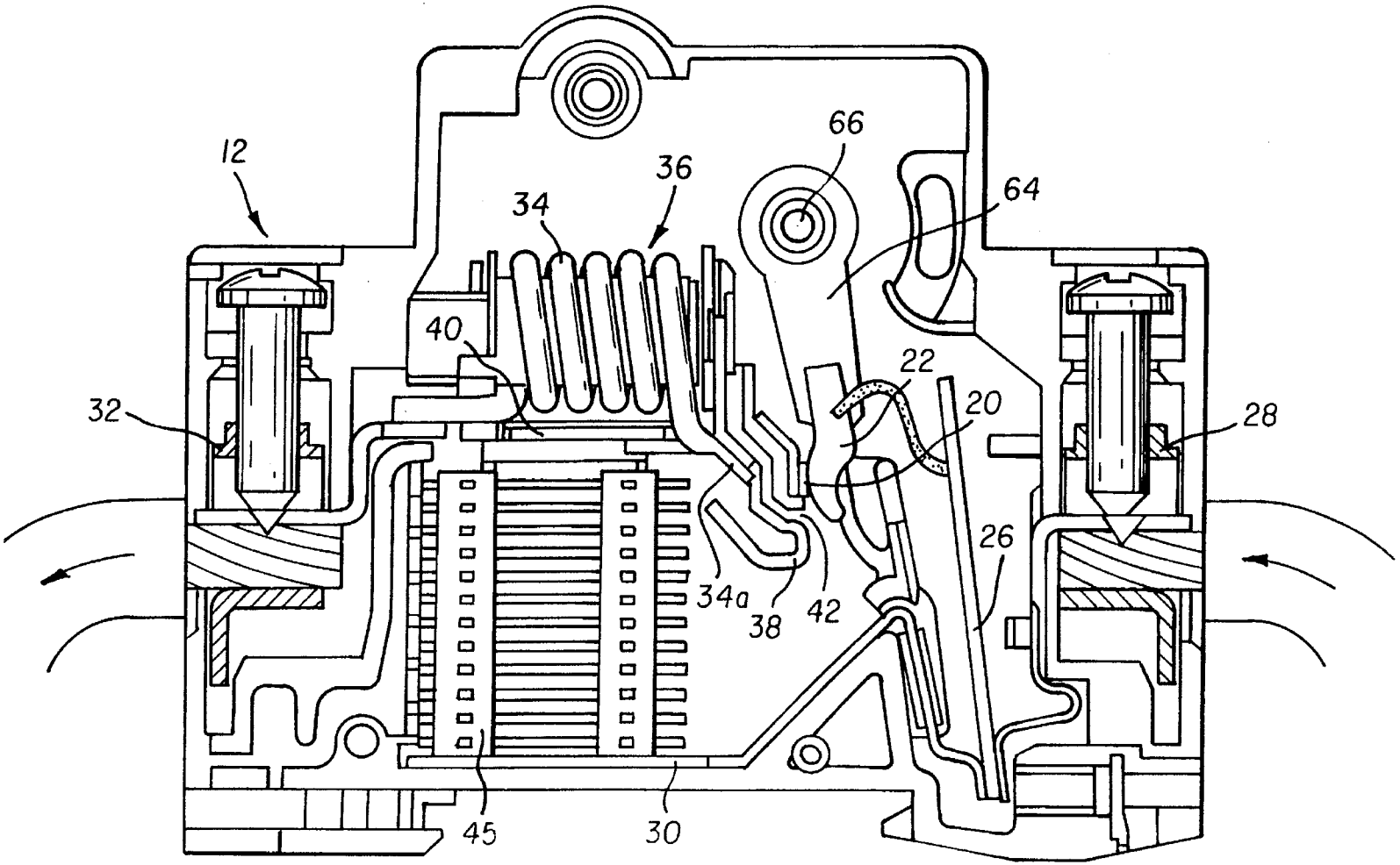
FIG. 3 represents an elevational view of the circuit breaker after the cover has been removed, the circuit breaker being in the closed state.

FIG. 3 shows the circuit breaker 12 in the closed position. The same reference numbers will be used to designate similar parts to those of FIG. 2. The movable contact 22 is supported by a contact arm 64 pivotally mounted on a spindle 66. The strips 50, 52 of the effector 14 are connected respectively to the stationary contact 20 and to the end 34*a* of the coil 34 which is at the potential of the switching electrode 38. The presence of the insulating gap 42 guarantees the insulation withstand between the input and output of the effector 14 when the contacts 20, 22 of the first switch circuit 16 are in the closed position, whereas the second switch circuit 18 is in the open state.

Figure 4:
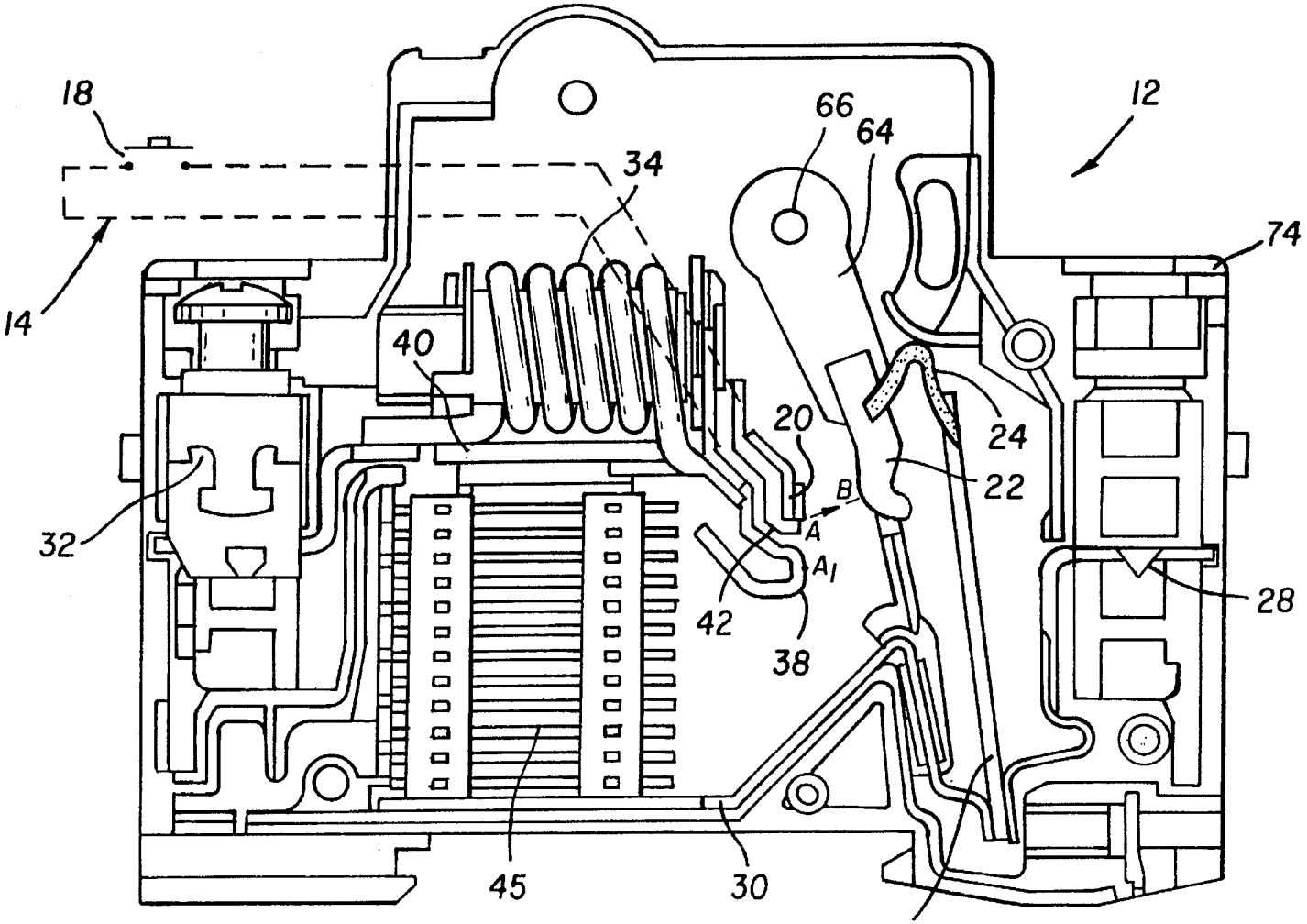
FIGS. 4 and 5 are identical views to FIG. 3, respectively at the beginning and end of the opening travel of the movable contact of the circuit breaker.
Figure 5:
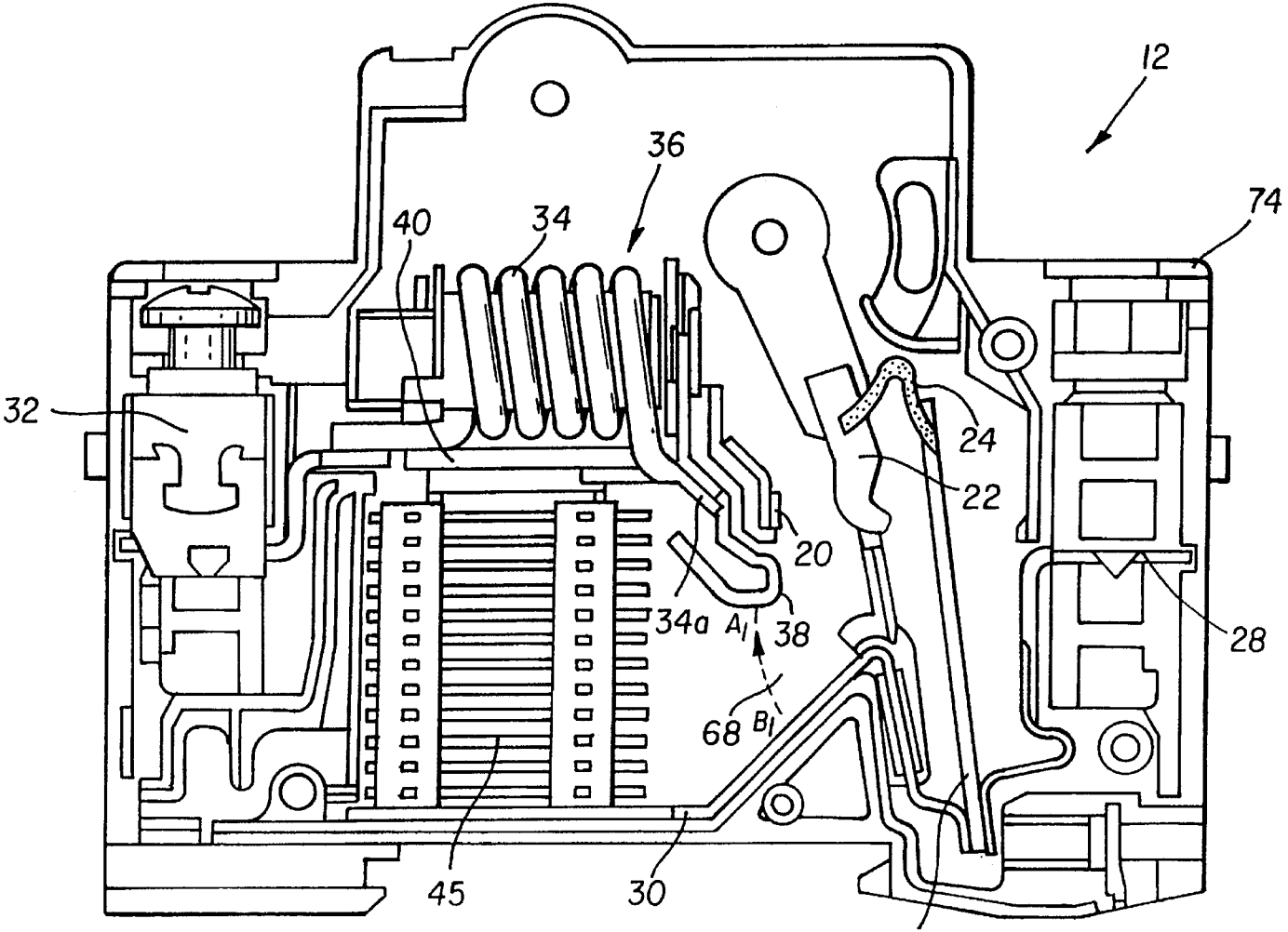

Migration of the arc onto the switching electrode 38 is represented in detail in FIGS. 4 and 5. At the beginning of the opening travel of the movable contact 22 of the circuit breaker 12 (FIG. 4), the arc is established along the path AB between the stationary contact 20 and movable contact 22. The effector 14 still remains electrically connected in series in the main circuit of the circuit breaker 12.

Shunting of the effector 14 takes place as soon as the arc root A migrates towards the switching electrode 38. The routing A1, B of the arc between the movable contact 22 and electrode 38 automatically stops the current flow in the effector 14. FIG. 5 shows the development of the arc A1 B1 in the formation chamber 68 just before it enters the extinguishing chamber 45. It can be noted that the coil 34 of the electromagnetic trip device remains supplied by the fault current so long as the arc moves along the switching electrode 38.

Figure 6:
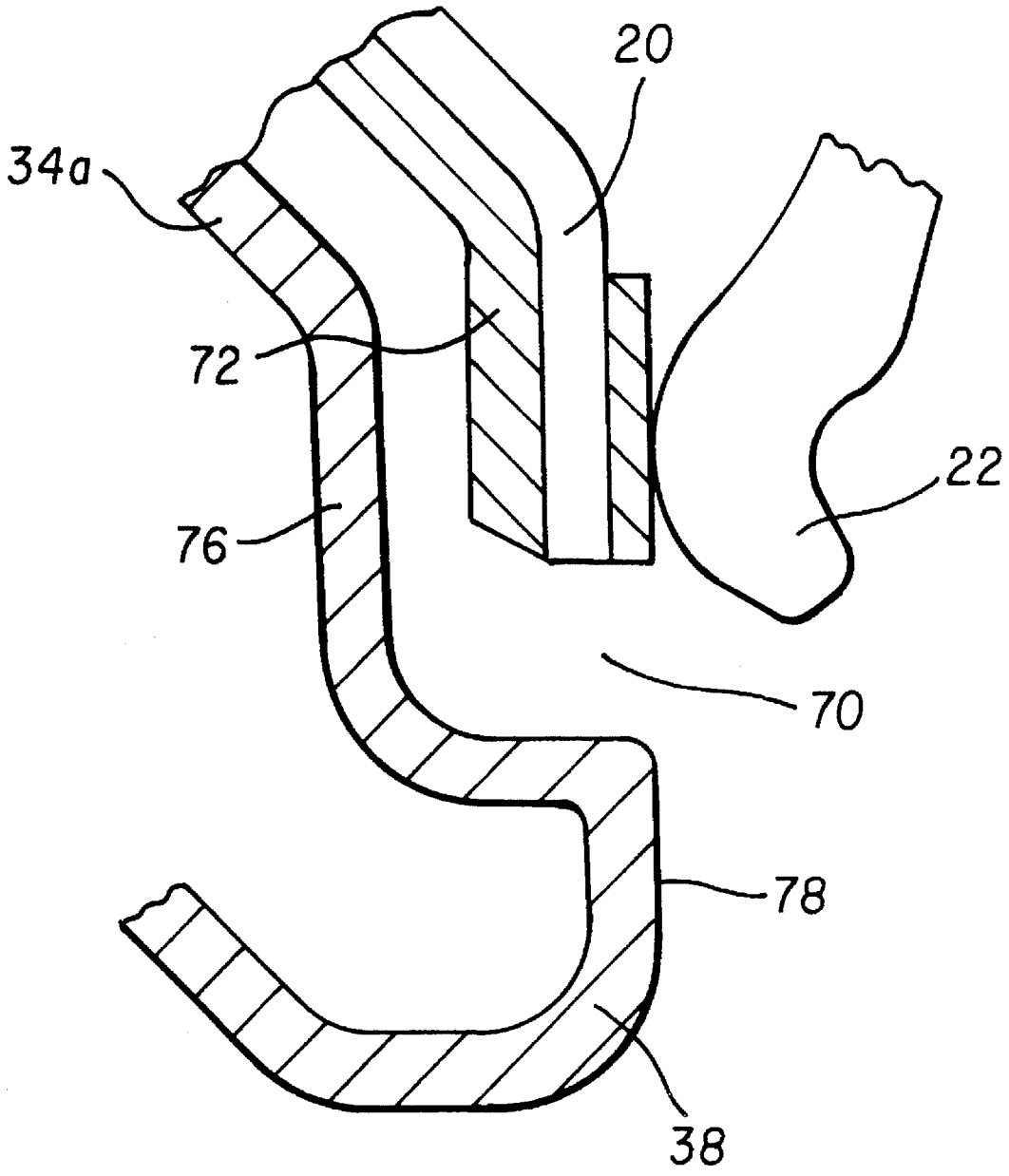
FIG. 6 shows a detailed view of the insulating gap.

In FIG. 6 representing in detail the arc switching zone, the insulating gap 42 is composed of a first air space 70 arranged between the lower part of the stationary contact 20 and the electrode 38 shaped as a half-loop, and of an intermediate wall 72 made of rigid insulating material acting as support for the stationary contact 20. The wall 72 is made by moulding with the plastic case 74 of the circuit breaker 12, and extends opposite the movable contact 22 between the stationary contact 20 and a conducting branch 76 connecting the electrode 38 to the end 34*a* of the coil 34.

The shape of the electrode 38 is adapted to enhance migration of the arc root during the breaking on a fault phase, while guaranteeing the dielectric withstand when the circuit breaker is closed. According to FIG. 6, the electrode 38 is equipped with a straight face 78 disposed in the extension of the plane of the stationary contact pad 20. The face 78 can also be convex to protrude out from the plane of the stationary contact 20.

Figure 7:
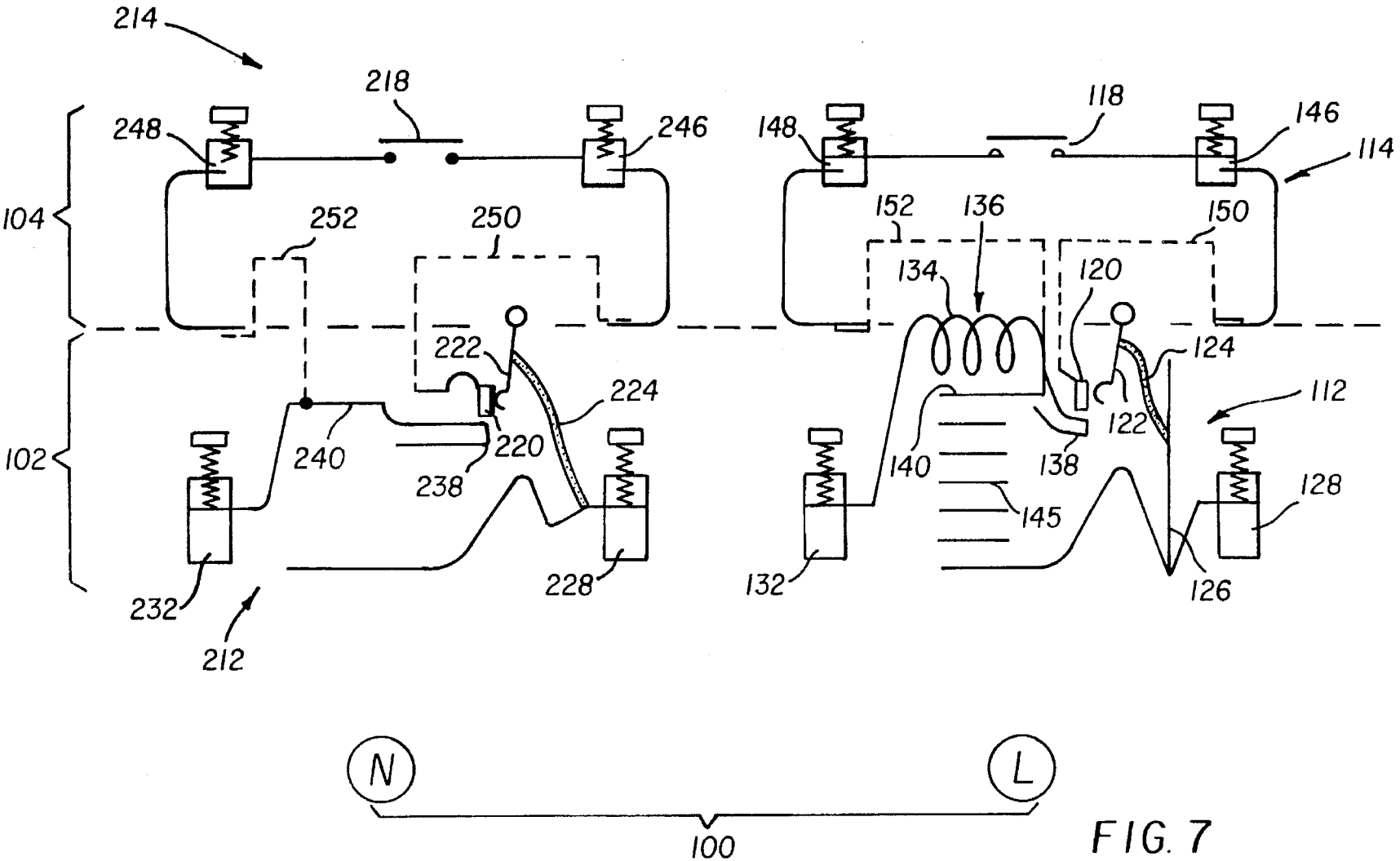
FIG. 7 is an identical view to FIG. 2, representing an alternative embodiment formed by association of a single-pole plus neutral circuit breaker and a two-pole effector.

The alternative embodiment of FIG. 7 relates to a two-pole apparatus 100 formed by association of a single-pole plus neutral circuit breaker 102 and a two-pole effector 104. The phase circuit L with its trip devices 126 and 136 is identical to the diagram of FIG. 2, the reference numbers of the same parts being attributed a digit 1 at the hundreds level. Operation of the phase circuit L of the apparatus 100 presents the same advantages as that described above. In the neutral circuit N, the reference numbers of similar parts are attributed a digit 2 at the hundreds level. The circuit breaker part of the neutral circuit N is not protected and is therefore not equipped with trip devices. The input terminal 228 is connected by the braid 224 to the movable contact 222, and the assembly formed by the guiding horn 240 and electrode 238 is connected directly to the output terminal 232. The connecting strip 250 is connected to the stationary contact 220, whereas the other connecting strip 252 is connected to the guiding horn 240. In the neutral circuit N, series connection of the effector 214 is performed between the stationary contact 220 and the switching electrode 238. The two parts 114, 214 of the two-pole effector 104 are thus powered off when the contacts 120, 220; 122, 222 of the circuit breaker 102 are open.

It is clear that the invention extends to two-pole, three-pole and four-pole circuit breakers, respectively associated with two-pole, three-pole and four-pole effectors.

We claim:

1. An electrical protection apparatus formed by association of a circuit breaker and an effector, the circuit breaker comprising a first switch circuit with stationary and movable contacts, a mechanism controlled by an electromagnetic trip device with operating coil and by a thermal trip device, a pair of first and second arc guiding horns associated with a switching electrode, arranged near the contacts of the first switch circuit, an arc extinguishing chamber in the trip devices circuit, an input terminal, and an output terminal, the effector having a second switch circuit arranged to be electrically connected in series with said first switch circuit when the latter is in the closed state, and to be automatically shunted by switching of the arc onto the electrode when the mechanism trips following a fault, wherein:

the switching electrode is separated from the stationary contact by an insulating gap, and is connected to one of the ends of the control coil of the electromagnetic trip device, the second switch circuit of the effector is connected to the stationary contact of the first switch circuit, and to said end of the coil, the insulating gap is shaped to enhance high-speed migration of the arc root onto the electrode when opening of the circuit breaker on a fault occurs and to guarantee the dielectric withstand in the closed state of the circuit breaker, and in the open state of the effector.

* * * * *